US009676545B2

(12) United States Patent
Sunder et al.

(10) Patent No.: US 9,676,545 B2
(45) Date of Patent: Jun. 13, 2017

(54) FRAGRANT, WATER-SOLUBLE PACKAGING

(71) Applicant: Henkel AG & Co. KGaA, Duesseldorf (DE)

(72) Inventors: Matthias Sunder, Duesseldorf (DE); Frank Meier, Duesseldorf (DE); Katherine G. Yu, Phoenix, AZ (US); Sabine Schuemann, Neuss (DE); Mario Sturm, Leverkusen (DE); Friedhelm Siepmann, Essen (DE); Andreas Bauer, Kaarst (DE)

(73) Assignee: Henkel AG & Co. KGaA (DE)

( * ) Notice: Subject to any disclaimer, the term of this patent is extended or adjusted under 35 U.S.C. 154(b) by 0 days.

(21) Appl. No.: 14/327,691

(22) Filed: Jul. 10, 2014

(65) Prior Publication Data

US 2014/0319015 A1 Oct. 30, 2014

Related U.S. Application Data

(63) Continuation of application No. PCT/EP2013/050192, filed on Jan. 8, 2013.

(60) Provisional application No. 61/585,419, filed on Jan. 11, 2012.

(51) Int. Cl.

| | |
|---|---|
| ***C11D 17/00*** | (2006.01) |
| ***B65D 85/804*** | (2006.01) |
| ***C11D 3/20*** | (2006.01) |
| ***C11D 3/50*** | (2006.01) |
| ***C11D 17/04*** | (2006.01) |
| ***B65B 5/04*** | (2006.01) |

(52) U.S. Cl.

CPC ..... *B65D 85/804* (2013.01); *B65B 5/04* (2013.01); *C11D 3/2041* (2013.01); *C11D 3/2065* (2013.01); *C11D 3/50* (2013.01); *C11D 17/0039* (2013.01); *C11D 17/043* (2013.01)

(58) Field of Classification Search

CPC ..... C11D 3/2065; C11D 17/043

See application file for complete search history.

(56) References Cited

U.S. PATENT DOCUMENTS

| | | | | |
|---|---|---|---|---|
| 6,727,215 | B2 * | 4/2004 | Roberts et al. | 510/296 |
| 2003/0104969 | A1 * | 6/2003 | Caswell | A47F 1/08 510/513 |
| 2003/0139312 | A1 * | 7/2003 | Caswell et al. | 510/320 |
| 2007/0054815 | A1 * | 3/2007 | Convents | C11D 3/386 510/101 |
| 2009/0247446 | A1 | 10/2009 | Barthel et al. | |
| 2009/0320212 | A1 | 12/2009 | Brown et al. | |

FOREIGN PATENT DOCUMENTS

| | | | |
|---|---|---|---|
| EP | 2336286 | A1 | 6/2011 |
| WO | 03/089563 | A2 | 10/2003 |
| WO | 2008/114189 | A2 | 9/2008 |

OTHER PUBLICATIONS

PCT International Search Report (PCT/EP2013/050192) dated Mar. 27, 2013.

* cited by examiner

*Primary Examiner* — John Hardee

(74) *Attorney, Agent, or Firm* — Thomas G. Krivulka

(57) ABSTRACT

The application describes fragrant water-soluble packaging which contains a liquid laundry detergent or cleaning composition and a water-soluble envelope. The liquid laundry detergent or cleaning composition comprises at least 10% by weight of glycerol, a second solvent, surfactant and a perfume, where the perfume contains particular amounts of perfume constituents.

6 Claims, No Drawings

FRAGRANT, WATER-SOLUBLE PACKAGING

FIELD OF THE INVENTION

The present invention generally relates to a water-soluble package comprising a water-soluble envelope and a liquid washing or cleaning agent. The invention also relates to the use of such a water-soluble package, and to a closable container comprising at least one such water-soluble package. A method for scenting a closable container is also described.

BACKGROUND OF THE INVENTION

Washing agents or treatment agents are available to consumers nowadays in a wide variety of presentation forms. Besides powders and granulates, this range also comprises, for example, liquids, gels, or portion packages (tablets or filled pouches).

Portion packages in particular meet the consumer's desire for simplified dispensing.

For many consumers, the scent of a washing or cleaning agent represents a major factor in terms of his or her purchase decision. In particular with liquid washing or cleaning agents that are sold in bottles, the consumer can already get an initial scent impression of the washing or cleaning agent at the store and thus before purchase by unscrewing the cap.

A disadvantage of portion pouches willed with liquid washing agents is that the consumer cannot determine the scent of the liquid washing agent in advance by simply opening the packaging.

One possibility for conveying to the consumer an impression of the scent of the liquid washing agent present in the portion package consists in subsequent scenting of the portion packages, for example by spraying on the perfume. This, however, complicates the method for manufacturing the water-soluble packages.

An object of the present invention was correspondingly to furnish a water-soluble package that conveys to the consumer, without external scenting, a scent impression regarding the perfuming of the washing or cleaning agent present therein.

Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

A water-soluble package that contains a liquid washing or cleaning agent and a water-soluble envelope, wherein the liquid washing or cleaning agent comprises at least 10 wt % glycerol, a second solvent, surfactant, and a perfume, wherein the perfume contains up to 25 wt % perfume ingredients having a c log P value>4 and a boiling point>250° C., up to 75 wt % perfume ingredients having a c log P value>3 and a boiling point>200° C., and up to 10 wt % perfume ingredients having a c log P value<2.

A closable container, comprising at least one water-soluble package that contains a liquid washing or cleaning agent and a water-soluble envelope, wherein the liquid washing or cleaning agent comprises at least 10 wt % glycerol, a second solvent, surfactant, and a perfume, wherein the perfume contains up to 25 wt % perfume ingredients having a c log P value>4 and a boiling point>250° C., up to 75 wt % perfume ingredients having a c log P value>3 and a boiling point>200° C., and up to 10 wt % perfume ingredients having a c log P value<2.

Use of a water-soluble package that contains a liquid washing or cleaning agent and a water-soluble envelope, wherein the liquid washing or cleaning agent comprises at least 10 wt % glycerol, a second solvent, surfactant, and a perfume, wherein the perfume contains up to 25 wt % perfume ingredients having a c log P value>4 and a boiling point>250° C., up to 75 wt % perfume ingredients having a c log P value>3 and a boiling point>200° C., and up to 10 wt % perfume ingredients having a c log P value<2, to scent the interior of a closable container.

A method for scenting the interior of a closable container, in which a water-soluble package that contains a liquid washing or cleaning agent and a water-soluble envelope, wherein the liquid washing or cleaning agent comprises at least 10 wt % glycerol, a second solvent, surfactant, and a perfume, wherein the perfume contains up to 25 wt % perfume ingredients having a c log P value>4 and a boiling point>250° C., up to 75 wt % perfume ingredients having a c log P value>3 and a boiling point>200° C., and up to 10 wt % perfume ingredients having a c log P value<2, is placed into the interior of the container.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

The object of the present invention is achieved by a water-soluble package that contains a liquid washing or cleaning agent and a water-soluble envelope, wherein the liquid washing or cleaning agent comprises at least 10 wt % glycerol, a second solvent, surfactant, and a perfume, wherein the perfume contains a) up to 25 wt % perfume ingredients having a c log P value>4 and a boiling point>250° C.,
b) up to 75 wt % perfume ingredients having a c log P value>3 and a boiling point>200° C., and
c) up to 10 wt % perfume ingredients having a c log P value<2.

It has become apparent, surprisingly, that the presence of large quantities of glycerol (≥10 wt % based on the total quantity of washing or cleaning agent) improves the permeability of the water-soluble package to perfume ingredients. As a result, the perfume ingredients arrive at the outer surface of the water-soluble package and impart a scent to it. A minimum quantity of 10 wt % glycerol is needed in order to achieve sufficiently high permeability to the perfume ingredients, and thus a scent impression perceptible to consumers.

In a preferred embodiment of the invention, the second solvent is a polyvalent alcohol selected from the group consisting of 1,2-propanediol, 1,3-propanediol, 2-methyl-1,3-propanediol, 1,4-butanediol, 2,3-butanediol, 1,5-pentanediol, diethylene glycol, triethanolamine, and mixtures thereof. The presence of a polyvalent alcohol is advantageous in terms of obtaining a clear, homogeneous washing or cleaning agent. A ratio of glycerol to polyvalent alcohol of between 10:1 and 1:2 is particularly advantageous, especially with regard to solubility/dispersibility in the washing bath and the stability of the packaged washing or cleaning agent.

It is also preferred that the water-soluble envelope contain polyvinyl alcohol or a polyvinyl alcohol copolymer. Water-soluble envelopes that contain polyvinyl alcohol or a polyvinyl alcohol copolymer exhibit good stability with sufficiently high water solubility, in particular solubility in cold water. Water-soluble packages having polyvinyl alcohol or a polyvinyl alcohol copolymer often possess an inherent odor of acetic acid. This scent impression of the water-soluble package, often perceived by the consumer as unpleasant, can be covered up by the emerging perfume ingredients.

In a particularly preferred embodiment, the perfume comprises at least 30 wt % perfume ingredients having an odor detection threshold ODT<50 $\mu g/m^3$.

The odor detection threshold (ODT) is the minimum concentration of a gaseous, sensorially active substance that a living being can just barely perceive with the sense of smell. It is advantageous if the perfume contains as many perfume ingredients as possible that have a low odor detection threshold, so that they can already be perceived, for example in the interior of a packaging container for water-soluble packages, at low concentrations.

The invention accordingly also relates to a closable container, comprising at least one water-soluble package that contains a liquid washing or cleaning agent and a water-soluble envelope, wherein the liquid washing or cleaning agent comprises at least 10 wt % glycerol, a second solvent, surfactant, and a perfume, wherein the perfume contains a) up to 25 wt % perfume ingredients having a c log P value>4 and a boiling point>250° C.,
b) up to 75 wt % perfume ingredients having a c log P value>3 and a boiling point>200° C., and
c) up to 10 wt % perfume ingredients having a c log P value<2.

A further subject of the invention is the use of a water-soluble package that contains a liquid washing or cleaning agent and a water-soluble envelope, wherein the liquid washing or cleaning agent comprises at least 10 wt % glycerol, a second solvent, surfactant, and a perfume, wherein the perfume contains a) up to 25 wt % perfume ingredients having a c log P value>4 and a boiling point>250° C.,
b) up to 75 wt % perfume ingredients having a c log P value>3 and a boiling point>200° C., and
c) up to 10 wt % perfume ingredients having a c log P value<2, to scent the interior of a closable container.

The invention further relates to a method for scenting the interior of a closable container, in which a water-soluble package that contains a liquid washing or cleaning agent and a water-soluble envelope, wherein the liquid washing or cleaning agent comprises at least 10 wt % glycerol, a second solvent, surfactant, and a perfume, wherein the perfume contains a) up to 25 wt % perfume ingredients having a c log P value>4 and a boiling point>250° C.,
b) up to 75 wt % perfume ingredients having a c log P value>3 and a boiling point>200° C., and
c) up to 10 wt % perfume ingredients having a c log P value<2, is placed into the interior of the container.

The invention will be described below in more detail, including with reference to examples.

The water-soluble package comprises a liquid washing or cleaning agent and a water-soluble envelope.

The liquid washing or cleaning agent comprises at least 10 wt % glycerol, a second solvent, surfactant, and a perfume.

The presence of at least 10 wt % glycerol, based on the total quantity of washing or cleaning agent, improves the permeability of the water-soluble envelope to perfume ingredients. A minimum quantity of 10 wt % glycerol is needed in this context in order to achieve sufficiently high permeability for the perfume ingredients, and thus a scent impression perceptible by consumers. The scent impression can be perceived on the one hand by "sniffing" the water-soluble package, or in the interior of a container in which at least one water-soluble package has been stored for at least 48 hours.

To further enhance the permeability of the water-soluble package to perfume ingredients and thus to enhance the scent impression, it is particularly preferred if the quantity of glycerol is equal to at least 15 wt % and very particularly preferably at least 20 wt %, based in each case on the total quantity of washing or cleaning agent.

It is preferred that the second solvent be present in the washing or cleaning agent in a quantity from 1 to 25 wt %, based on the total quantity of washing or cleaning agent.

It is particularly preferred that the second solvent be a polyvalent alcohol selected from the group consisting of 1,2-propanediol, 1,3-propanediol, 2-methyl-1,3-propanediol, 1,4-butanediol, 2,3-butanediol, and 1,5-pentanediol, diethylene glycol, triethanolamine, and mixtures thereof. 1,2-Propanediol and/or 2-methyl-1,3-propanediol are used with particular advantage as a second solvent. Especially with regard to solubility/dispersibility in the washing bath and the stability of the packaged washing or cleaning agent, it is particularly advantageous if the ratio of glycerol to polyvalent alcohol is between 10:1 and 1:2.

The washing or cleaning agent further contains a perfume, in order to improve the overall aesthetic impression of the products and also, in addition to technical performance (e.g. cleaning of the textiles), to impart a pleasant scent to the textiles treated therewith.

Individual compounds can be utilized as a perfume, but it is particularly preferred to use a perfume that contains multiple ingredients. These perfume ingredients can be, for example, synthetic or natural compounds of the ester, ether, aldehyde, ketone, alcohol, and hydrocarbon types.

The perfume is present in the washing or cleaning agent in a quantity preferably from 0.1 to 5 wt %, more preferably 0.2 to 3 wt %, and particularly preferably 0.3 to 2 wt %, based in each case on the total washing or cleaning agent.

In order to ensure sufficiently high permeability of the perfume ingredients through the water-soluble envelope, the perfume comprises up to 25 wt % perfume ingredients having a c log P value>4 and a boiling point>250° C., up to 75 wt % perfume ingredients having a c log P value>3 and a boiling point>200° C., and up to 10 wt % perfume ingredients having a c log P value<2.

It has been found, surprisingly, that the use of perfumes having such a composition of perfume ingredients results in particularly intensively fragrant water-soluble packages.

The octanol/water distribution coefficient of a perfume ingredient is the ratio between its equilibrium concentration in octanol and in water. Because the distribution coefficients of the scent constituents often have high values, for example 1000 or higher, they are usefully indicated in the form of their base-10 logarithm; the term used is then the so-called "log P" value.

The log P values of numerous perfume ingredients are documented. The log P values are, however, most usefully calculated using the "C LOG P" program, available from Daylight Chemical Information Systems, Inc. (Daylight CIS), Irvine, Calif. The "calculated log P values" (=c log P values), which are the most reliable and most widely used estimated values for this physico-chemical property, are used in the context of this invention when selecting the perfume ingredients.

The liquid washing or cleaning agent contains a surfactant, which can be e.g. an anionic surfactant, a nonionic surfactant, a zwitterionic surfactant, a cationic surfactant, or a mixture thereof. The liquid washing or cleaning agent preferably contains anionic and nonionic surfactant.

Sulfonates and/or sulfates can preferably be used as an anionic surfactant. The anionic surfactant content is 5 to 25 wt % and preferably 8 to 20 wt %, based in each case on the total washing or cleaning agent.

Possibilities as surfactants of the sulfonate type are preferably $C_{9-13}$ alkylbenzenesulfonates, olefinsulfonates, i.e. mixtures of alkene- and hydroxyalkanesulfonates, and disulfonates, for example such as those obtained from $C_{12-18}$ monoolefins having a terminal or internal double bond, by sulfonation with gaseous sulfur trioxide and subsequent alkaline or acid hydrolysis of the sulfonation products. Also suitable are $C_{12-18}$ alkanesulfonates and esters of $\alpha$-sulfo fatty acids (estersulfonates), for example $\alpha$-sulfonated methyl esters of hydrogenated coconut, palm kernel, or tallow fatty acids.

Preferred alk(en)yl sulfates are alkali, and in particular sodium, salts of sulfuric acid semi-esters of the $C_{12}$ to $C_{18}$ fatty alcohols, for example from coconut fatty alcohol, tallow fatty alcohol, lauryl, myristyl, cetyl, or stearyl alcohol, or $C_{10}$ to $C_{20}$ oxo alcohols, and those semi-esters of secondary alcohols of those chain lengths. For purposes of washing technology, $C_{12}$ to $C_{16}$ alkyl sulfates and $C_{12}$ to $C_{15}$ alkyl sulfates, as well as $C_{14}$ to $C_{15}$ alkyl sulfates, are preferred. 2,3-Alkyl sulfates are also suitable anionic surfactants.

Fatty alcohol ether sulfates, such as sulfuric acid monoesters of straight-chain or branched $C_{7-21}$ alcohols ethoxylated with 1 to 6 mol ethylene oxide, such as 2-methyl-branched $C_{9-11}$ alcohols with an average of 3.5 mol ethylene oxide (EO), or $C_{12-18}$ fatty alcohols with 1 to 4 EO, are also suitable.

Soaps are further suitable anionic surfactants. Saturated and unsaturated fatty acid soaps, such as the salts of lauric acid, myristic acid, palmitic acid, stearic acid, (hydrogenated) erucic acid, and behenic acid, are suitable, as are soap mixtures derived in particular from natural fatty acids, e.g. coconut, palm-kernel, olive-oil, or tallow fatty acids.

Anionic surfactants, as well as soaps, can be present in the form of their sodium, potassium, magnesium, or ammonium salts. Anionic surfactants are preferably present in the form of their ammonium salts. Preferred counter ions for the anionic surfactants are the protonated forms of choline, triethylamine, monoethanolamine, or methylethylamine.

Suitable nonionic surfactants comprise alkoxylated fatty alcohols, alkoxylated fatty acid alkyl esters, fatty acid amides, alkoxylated fatty acid amides, polyhydroxy fatty acid amides, alkylphenol polyglycol ethers, amine oxides, alkyl polyglucosides, and mixtures thereof.

The nonionic surfactants used are preferably alkoxylated, advantageously ethoxylated, in particular primary alcohols having preferably 8 to 18 carbon atoms and an average of 4 to 12 mol ethylene oxide (EO) per mol of alcohol, in which the alcohol residue can be linear or preferably methyl-branched in the 2-position, or can contain mixed linear and methyl-branched residues, such as those that are usually present in oxo alcohol residues. Particularly preferred, however, are alcohol ethoxylates having linear residues made up of alcohols of natural origin having 12 to 18 carbon atoms, e.g. from coconut, palm, tallow, or oleyl alcohol, and an average of 5 to 8 EO per mol of alcohol. The preferred ethoxylated alcohols include, for example, $C_{12-14}$ alcohols with 4 EO or 7 EO, $C_{9-11}$ alcohol with 7 EO, $C_{13-15}$ alcohols with 5 EO, 7 EO, or 8 EO, $C_{12-18}$ alcohols with 5 EO or 7 EO, and mixtures thereof. The degrees of ethoxylation indicated represent statistical averages, which can correspond to an integer or a fractional number for a specific product. Preferred alcohol ethoxylates exhibit a restricted distribution of homologs (narrow range ethoxylates, NRE). In addition to these nonionic surfactants, fatty alcohols with more than 12 EO can also be used. Examples of these are tallow fatty alcohol with 14 EO, 25 EO, 30 EO, or 40 EO. Nonionic surfactants that contain EO and PO groups together in the molecule are also usable according to the present invention. A mixture of a (more highly) branched ethoxylated fatty alcohol and an unbranched ethoxylate fatty alcohol is also suitable, for example a mixture of a $C_{16-18}$ fatty alcohol with 7 EO and 2-propylheptanol with 7 EO. Particularly preferably, the washing, cleaning, post-treatment, or washing auxiliary agent contains a $C_{12-18}$ fatty alcohol with 7 EO or a $C_{13-15}$ oxoalcohol with 7 EO as a nonionic surfactant.

The nonionic surfactant content is 1 to 25 wt % and preferably 2 to 20 wt %, based in each case on the total liquid washing or cleaning agent.

The total quantity of anionic and nonionic surfactant in the liquid washing or cleaning agent is up to 50 wt %, preferably up to 45 wt %, based on the total liquid washing or cleaning agent.

In addition to the glycerol, the second solvent, perfume, and the surfactant, the washing or cleaning agent can contain further ingredients that further improve the applications-engineering and/or aesthetic properties of the washing or cleaning agent. In the context of the present invention the washing or cleaning agent preferably additionally contains one or more substances from the group of builders, bleaching agents, bleach catalysts, bleach activators, enzymes, electrolytes, pH adjusting agents, perfumes, perfume carriers, fluorescence agents, dyes, hydrotopes, foam inhibitors, silicone oils, anti-redeposition agents, anti-gray agents, shrinkage preventers, wrinkle-prevention agents, color transfer inhibitors, antimicrobial active substances, germicides, fungicides, antioxidants, preservatives, corrosion inhibitors, antistatic agents, bittering agents, ironing adjuvants, proofing and impregnation agents, skin-care active substances, swelling and anti-slip agents, softening components, corrosion inhibitors, and UV absorbers.

The washing or cleaning agents contained in the water-soluble package are liquid. The washing or cleaning agents can contain water, the water content being preferably less than 20 wt %, more preferably less than 15 wt %, and very particularly preferably less than 10 wt %, based in each case on the total washing or cleaning agent.

The water-soluble package contains, besides the liquid washing or cleaning agent, a water-soluble envelope. The water-soluble envelope is preferably constituted by a water-soluble film material.

Water-soluble packages of this kind can be manufactured either by vertical form fill sealing (VFFS) methods, or by thermoforming methods.

The thermoforming method usually includes the shaping of a first ply made of a water-soluble film material in order to form bulges for receiving a composition within them;

introducing the composition into the bulges; covering the protrusions, filled with the compositions, with a second ply of a water-soluble film material; and sealing the first and second ply to one another at least around the bulges.

The water-soluble envelope is preferably constituted from a water-soluble film material selected from the group consisting of polymers or polymer mixtures. The envelope can be constituted from one or from two or more plies of the water-soluble film material. The water-soluble film material of the first ply and of the further plies if present can be the same or different.

The water-soluble package, comprising the liquid washing or cleaning agent and the water-soluble envelope, can comprise one or more chambers. The liquid washing or cleaning agent can be contained in one or several chambers, if present, of the water-soluble envelope. In a preferred embodiment the water-soluble package comprises two chambers. In this embodiment the first chamber contains the liquid washing or cleaning agent and the second chamber contains a solid or liquid agent.

The agents that are contained in the different chambers of a water-soluble package having two or more chambers can have the same composition. Preferably, the agents in a water-soluble package having at least two chambers have compositions that differ from one another at least in terms of one ingredient or at least in terms of the concentration of one ingredient.

Water-soluble packages having at least two chambers have the advantage that incompatible ingredients can be present in separate chambers. A further advantage results in the context of suspensions having solid and liquid ingredients, which are often regarded by the user of the water-soluble package as relatively unattractive and/or as defective. In such a case the solid or insoluble ingredients can be contained in a separate chamber of the water-soluble package.

It is preferred that the water-soluble envelope contain polyvinyl alcohol or a polyvinyl alcohol copolymer.

Suitable water-soluble films for manufacturing the water-soluble envelope are preferably based on a polyvinyl alcohol or a polyvinyl alcohol copolymer, the molecular weight of which is in the range from 10,000 to 1,000,000 $gmol^{-1}$, preferably from 20,000 to 500,000 $gmol^{-1}$, particularly preferably from 30,000 to 100,000 $gmol^{-1}$, and in particular from 40,000 to 80,000 $gmol^{-1}$.

The manufacture of polyvinyl alcohol is usually accomplished by hydrolysis of polyvinyl acetate, since the direct synthesis pathway is not possible. The same applies to polyvinyl alcohol copolymers, which are manufactured correspondingly from polyvinyl acetate copolymers. It is preferred if at least one ply of the water-soluble envelope comprises a polyvinyl alcohol whose degree of hydrolysis is equal to 70 to 100 mol %, preferably 80 to 90 mol %, particularly preferably 81 to 89 mol %, and in particular 82 to 88 mol %.

The acetate groups contained in the film material of the water-soluble envelope become partly hydrolyzed upon storage of the water-soluble package. In the case of a water-soluble package according to the invention, the inherent acetic-acid odor is covered up by the perfume ingredients that travel out of the liquid washing or cleaning agent, through the envelope that is permeable to perfume ingredients, to the outer surface of the water-soluble package.

A film material suitable for manufacturing the water-soluble envelope can additionally have polymers added to it, selected from the group comprising acrylic-acid-containing polymers, polyacrylamides, oxazoline polymers, polystyrene sulfonates, polyurethanes, polyesters, polyethers, polylactic acid, and/or mixtures of the aforesaid polymers.

Preferred polyvinyl alcohol copolymers comprise dicarboxylic acids as further monomers in addition to vinyl alcohol. Suitable dicarboxylic acids are itaconic acid, malonic acid, succinic acid, and mixtures thereof, itaconic acid being preferred.

Polyvinyl alcohol copolymers that are also preferred comprise, besides vinyl alcohol, an ethylenically unsaturated carboxylic acid or a salt or ester thereof. Besides vinyl alcohol, such polyvinyl alcohol copolymers particularly preferably contain acrylic acid, methacrylic acid, acrylic acid esters, methacrylic acid esters, or mixtures thereof.

Suitable water-soluble films for use in the envelopes of the water-soluble packages according to the invention are films that are marketed under the Monosol M8630 designation by MonoSol LLC. Other suitable films comprise films having the designations Solublon® PT, Solublon® KA, Solublon® KC, or Solublon® KL of Aicello Chemical Europe GmbH, or the VF-HP films of Kuraray.

A water-soluble package can be stored in a closable container, and the interior of the closable container can thus be scented.

The closable container is usually embodied to receive a plurality of water-soluble packages.

A container for purposes of this Application is an apparatus which is intended to encase a plurality of water-soluble packages in such a way that they are capable of being shipped, stored, and/or sold.

The container usually comprises a bottom and an enveloping surface, by means of which an interior for receiving the water-soluble packages is formed. The container furthermore as a rule comprises an opening for removing the water-soluble packages from the container, the opening being closable by means of a closure.

The container is, in particular, configured so that in the closed state, no release of scent from the container into the environment occurs.

The container for receiving the water-soluble packages preferably exhibits the lowest possible water vapor permeability, in order to protect the water-soluble packages stored in it from undesired exposure to water vapor.

According to a first preferred embodiment, the container is embodied as a dimensionally stable container, for example in the form of a closable box, can, bottle, or carton.

It is in principle also possible to configure the container as a dimensionally non-stable container, for example as a pouch or bag. It is particularly advantageous in this connection to embody the dimensionally non-stable container as a stand-up pouch.

The container is preferably constituted from a plastic. It is also possible to constitute the container from a cellulose-containing material such as paper, paperboard, or cardboard. The container can of course also be manufactured from multi-layer materials comprising plastics, cellulose-containing materials, and/or metallic materials. Composite materials made up of a cellulose-containing carrier material that is laminated with a plastic film and/or metal foil are appropriate here.

In the context of cans these can be, in particular, a deep-drawn can, easy-open can, press-in lid can, necked-in can, open-top round can, filler-hole open-top round can, folded can, drawn can, piston can, convolute can, pull-tab can, snap-on lid can, slip lid can, or stepped rim can.

A bottle can be embodied, for example, as a see-through bottle, ale bottle, Bocksbeutel, swing stopper bottle, renana bottle, steinie bottle, stubby bottle, vichy bottle, wide mouth bottle, as well as a Megplat bottle, squeeze bottle, dropper bottle, or as a packaging bottle such as, for example, a flacon.

A flexible container for purposes of this Application is a packing means whose shape changes substantially even under low stress when used as intended. The flexible packing means is embodied in particular as a pouch.

The bag can be selected, for example, from the group of bottom bags, block bags, stock bags, block bottom bags, stock bottom bags, stand-up bottom bags, bottom-fold bags, cross-bottom bags, round-bottom bags, stand-up bags, double bags, window bags, flat bags, flap bags, flap-pocket bags, conical bags, tubular bags, side-fold bags, folding bags, edge-sealed bags, three-edge sealed bags, two-seam bags, foldover flap bags, carrier bags, and/or valve bags.

The container can also be embodied as a two- or multi-chamber container. Advantageously, the chambers then contain products that each differ from one another. It is thus possible, for example, to stock a first group of water-soluble packages in one chamber and a second group of water-soluble packages in a further chamber.

In order to ensure on the one hand a sufficient concentration of perfume in the gas phase of the container interior, and on the other hand sufficient penetration and/or diffusion of the perfume in the gas phase and thus propagation in the container interior, the ratio of the internal volume of the container to the unoccupied volume between the water-soluble packages is 1:1 to 5:1, preferably 2:1 to 4:1, particularly preferably 2.7:1 to 3.4:1. The unoccupied volume between the water-soluble packages is calculated from the volume of the container minus the sum of the volumes of the individual water-soluble packages present in the container.

The water-soluble packages are advantageously arranged as unconstrained bulk fill in the container. This ensures that the largest possible surface area of the water-soluble packages is in uncovered contact with the gas phase of the internal container space, and the contact surface areas among water-soluble packages, and between the water-soluble packages and the inner wall of the container, are as small as possible. Substantially dimensionally stable spherical or cushion-shaped conformations of the film pouches, with a circular, elliptical, square, or rectangular basic shape, have proven to be very particularly preferable in this connection.

EXAMPLES

For the manufacture of water-soluble packages, firstly liquid washing or cleaning agents were manufactured by means of usual and known methods and processes. Table 1 below shows the compositions of four washing or cleaning agents E1 to E4 that are used in water-soluble packages according to the present invention, as well as the compositions of four comparison examples V1 to V4 that are used in water-soluble packages not according to the present invention.

TABLE 1

Liquid washing or cleaning agents E1 to E4 and V1 to V4 (all quantities indicated as wt % active substance, based on the composition).

| Ingredients | E1 | E2 | E3 | E4 | V1 |
|---|---|---|---|---|---|
| $C_{10}$-$C_{13}$ alkylbenzenesulfonic acid | 17 | 17 | 17 | 17 | 17 |
| $C_{12}$-$C_{18}$ ROH (7 EO) | 19 | 19 | 19 | 19 | 19 |
| Glycerol | 21.7 | 10.85 | 10.85 | 10.85 | 5 |
| 1,2-Propanediol | 7.84 | 17.15 | 15.48 | 12.6 | 24.44 |
| 2-Methyl-1,3-propanediol | 0 | 1.6 | 3.2 | 6.4 | 0 |
| Ethanol | 3.26 | 3.26 | 3.26 | 3.26 | 3.26 |
| Coconut fatty acid | 15 | 15 | 15 | 15 | 15 |
| Phosphonate | 0.9 | 0.9 | 0.9 | 0.9 | 0.9 |
| Monoethanolamine | 7.35 | 7.35 | 7.42 | 7.1 | 7.1 |
| Dyes, enzymes (cellulase, amylase & protease), optical brighteners, perfume | 2 | 2 | 2 | 2 | 2 |
| Water | 5.9 | 5.84 | 5.84 | 5.84 | 6.25 |

| Ingredients | V2 | V3 | V4 |
|---|---|---|---|
| $C_{10}$-$C_{13}$ ABS | 17 | 17 | 17 |
| $C_{12}$-$C_{18}$ ROH (7 EO) | 19 | 19 | 19 |
| Glycerol | 0 | 0 | 2.5 |
| 1,2-Propanediol | 29.88 | 22.05 | 26.7 |
| 2-Methyl-1,3-propanediol | 0 | 6.11 | 0 |
| Ethanol | 3.26 | 3.89 | 0 |
| Coconut fatty acid | 15 | 15 | 15 |
| Phosphonate | 0.9 | 0.9 | 0.9 |
| Monoethanolamine | 7.1 | 7 | 7 |
| Dyes, enzymes (cellulase, amylase & protease), optical brighteners, perfume | 2 | 2 | 2 |
| Water | 5.81 | 7 | 9.85 |

The perfume contained 17.22 wt % perfume ingredients having a c log P value>4 and a boiling point>250° C., 48.14 wt % perfume ingredients having a c log P value>3 and a boiling point>200° C., 4.38 wt % perfume ingredients having a c log P value<2, and 53.14 wt % perfume ingredients having an odor detection threshold ODT≤50 $\mu g/m^3$.

For the manufacture of water-soluble packages having washing or cleaning agents E1 to E4 and V1 to V4, a film of the M8630 type (from Monosol) having a thickness of 76 μm was drawn into a recess under vacuum to form a bulge. The bulge was then filled with 30 ml of one of the liquid washing or cleaning agents E1 to E4 and V1 to V4. After the agent-filled bulges had covered with a second ply of a film of the M8630 type, the first and second plies were heat-sealed to one another. The sealing temperature was 150° C., and the sealing duration 1.1 seconds.

For odor determination, each water-soluble package was stored in air-tight fashion in a screw-top jar at room temperature. After two days the jars were opened, and the water-soluble packages as well as the gas phase in the interior of the screw-top jars were evaluated olfactorily: the samples were sniffed by five trained persons, and the intensity of the perfume odor was determined.

In the case of the water-soluble packages that had been filled with the liquid washing or cleaning agent E1, a strong perfume odor was perceived on the water-soluble package itself and in the interior of the respective screw-top jar. In the case of the water-soluble packages that had been filled with the liquid washing or cleaning agents E2, E3, and E4, a weak perfume odor was perceived in each case on the water-soluble package itself and in the interior of the respective screw-top jar. In the case of the water-soluble packages that had been filled with the liquid washing or cleaning agents V1 to V4, no perfume odor was perceived either on the water-soluble packages themselves or in the interior of the respective screw-top jars.

After the water-soluble packages having the washing or cleaning agents E1 to E4 had been stored for 8 weeks, no partial or complete dissolution of the water-soluble envelope was observed. In addition, no pores or holes that would likewise cause product discharge or leakage were detected.

Table 2 below shows the compositions of two further washing or cleaning agents E5 and E6 that are employed in water-soluble packages according to the present invention.

TABLE 2

Liquid washing or cleaning agents E5 and E6 (all quantities indicated as wt % active substance, based on the composition).

| Ingredients | E5 | E6 |
|---|---|---|
| Potassium tripolyphosphate | 21 | — |
| Glutaminediacetic acid, sodium salt | — | 21 |
| Sodium citrate | 4 | 4 |
| Hydroxy mixed ethers | 2 | 2 |
| Glycerol | 27 | 27 |
| 1,2-Propanediol | 10 | 10 |
| Sulfopolymer | 9 | 9 |
| Phosphonate | 2.5 | 2.5 |
| Monoethanolamine | 3.5 | 3.5 |
| Dyes, enzymes, and perfume | 3 | 3 |
| Water | 18 | 18 |

The perfume contained 3 wt % perfume ingredients having a c log P value>4 and a boiling point>250° C., 32 wt % perfume ingredients having a c log P value>3 and a boiling point>200° C., and 3 wt % perfume ingredients having a c log P value<2.

For the manufacture of water-soluble packages having washing or cleaning agents E5 and E6, a film of the M8630 type (from Monosol) having a thickness of 76 μm was drawn into a recess under vacuum to form a bulge. The bulge was then filled with 30 ml of one of the liquid washing or cleaning agents E5 or E6. After the agent-filled bulges had been covered with a second ply of a film of the M8630 type, the first and second plies were heat-sealed to one another. The sealing temperature was 150° C., and the sealing duration 1.1 seconds.

For odor determination, each water-soluble package was stored in air-tight fashion in a screw-top jar at room temperature. After two days the jars were opened, and the water-soluble packages as well as the gas phase in the interior of the screw-top jars were evaluated olfactorily: the samples were sniffed by five trained persons, and the intensity of the perfume odor was determined.

In the case of the water-soluble packages that had been filled with the liquid washing or cleaning agents E5 and E6, a strong perfume odor was perceived on the water-soluble package itself and in the interior of the respective screw-top jar.

After the water-soluble packages having the washing or cleaning agents E1 to E4 had been stored for 8 weeks, no partial or complete dissolution of the water-soluble envelope was observed. In addition, no pores or holes that would likewise cause product discharge or leakage were detected.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A water-soluble package that contains a liquid cleaning agent and a water-soluble envelope, wherein the liquid cleaning agent comprises at least 20 wt % glycerol; a polyvalent alcohol selected from the group consisting of 1,2-propanediol, 1,3-propanediol, 2-methyl-1,3-propanediol, 1,4-butanediol, 2,3-butanediol, 1,5-pentanediol, diethylene glycol, triethanolamine, and mixtures thereof; from 5 to 25 wt % of anionic surfactant selected from the group consisting of $C_{9-13}$ alkylbenzenesulfonates, $C_{12-18}$ olefinsulfonates, $C_{12-18}$ alkanesulfonates, estersulfonates, sodium salts of sulfuric acid semi-esters of $C_{12}$ to $C_{18}$ fatty alcohols, sulfuric acid monoesters of straight-chain or branched $C_{7-21}$ alcohols ethoxylated with 1 to 6 mol ethylene oxide, saturated and unsaturated fatty acid soaps, and mixtures thereof; from 1 to 25 wt % nonionic surfactant; and from 0.1 to 5 wt % of a perfume, wherein the perfume contains a) up to 25 wt % perfume ingredients having a c log P value>4 and a boiling point>250° C., b) up to 75 wt % perfume ingredients having a c log P value>3 and a boiling point>200° C., and c) up to 10 wt % perfume ingredients having a c log P value<2.

2. The water-soluble package according to claim 1, wherein the ratio of glycerol to polyvalent alcohol is between 10:1 and 1:2.

3. The water-soluble package according to claim 1, wherein the water-soluble envelope contains polyvinyl alcohol or a polyvinyl alcohol copolymer.

4. The water-soluble package according to claim 1, wherein the perfume contains at least 30 wt % perfume ingredients having an odor detection threshold ODT≤50 $\mu g/m^3$.

5. A closable container, comprising at least one water-soluble package that contains a liquid cleaning agent and a water-soluble envelope, wherein the liquid cleaning agent comprises at least 20 wt % glycerol, a second solvent, from 5 to 25 wt % of anionic surfactant, from 1 to 25 wt % nonionic surfactant, and from 0.1 to 5 wt % of a perfume, wherein the perfume contains a) up to 25 wt % perfume ingredients having a c log P value>4 and a boiling point>250° C., b) up to 75 wt % perfume ingredients having a c log P value>3 and a boiling point>200° C., and c) up to 10 wt % perfume ingredients having a c log P value<2.

6. A method for scenting the interior of a closable container, in which a water-soluble package that contains a liquid cleaning agent and a water-soluble envelope, wherein the liquid cleaning agent comprises at least 20 wt % glycerol; a second solvent selected from the group consisting of 1,2-propanediol, 1,3-propanediol, 2-methyl-1,3-propanediol, 1,4-butanediol, 2,3-butanediol, 1,5-pentanediol, diethylene glycol, triethanolamine, and mixtures thereof; from 5 to 25 wt % of anionic surfactant selected from the group consisting of $C_{9-13}$ alkylbenzenesulfonates, $C_{12-18}$ olefinsulfonates, $C_{12-18}$ alkanesulfonates, estersulfonates, sodium salts of sulfuric acid semi-esters of $C_{12}$ to $C_{18}$ fatty alcohols, sulfuric acid monoesters of straight-chain or branched $C_{7-21}$ alcohols ethoxylated with 1 to 6 mol ethylene oxide, saturated and unsaturated fatty acid soaps, and mixtures thereof; from 1 to 25 wt % nonionic surfactant, and from 0.1 to 5 wt % of a perfume, wherein the perfume contains a) up to 25 wt % perfume ingredients having a c log P value>4 and a boiling point>250° C., b) up to 75 wt % perfume ingredients having a c log P value>3 and a boiling point>200° C., and c) up to 10 wt % perfume ingredients having a c log P value<2, is placed into the interior of the container.

* * * * *